US009895586B2

(12) United States Patent
Hecht

(10) Patent No.: US 9,895,586 B2
(45) Date of Patent: Feb. 20, 2018

(54) GOLF TROLLEY, SYSTEMS, AND RELATED METHODS

(71) Applicant: Abe Hecht, Beverly Hills, CA (US)

(72) Inventor: Abe Hecht, Beverly Hills, CA (US)

( * ) Notice: Subject to any disclaimer, the term of this patent is extended or adjusted under 35 U.S.C. 154(b) by 0 days.

(21) Appl. No.: 15/272,855

(22) Filed: Sep. 22, 2016

(65) Prior Publication Data

US 2017/0319921 A1 Nov. 9, 2017

Related U.S. Application Data

(60) Provisional application No. 62/333,440, filed on May 9, 2016.

(51) Int. Cl.
*A63B 55/60* (2015.01)
*A63B 55/30* (2015.01)
*A63B 55/40* (2015.01)

(52) U.S. Cl.
CPC ..... *A63B 55/60* (2015.10); *A63B 55/30* (2015.10); *A63B 55/40* (2015.10); *A63B 2210/50* (2013.01); *A63B 2210/58* (2013.01)

(58) Field of Classification Search
CPC ..... A63B 55/00; A63B 55/30; A63B 55/40; A63B 55/60
See application file for complete search history.

(56) References Cited

U.S. PATENT DOCUMENTS 2,868,559 A * 1/1959 Anthony ..... A63B 55/60 280/13
4,062,564 A * 12/1977 Schimmeyer ..... B62B 5/085 280/652
4,726,597 A * 2/1988 Hickin ..... A63B 55/60 224/401
5,879,022 A * 3/1999 Winton ..... A63B 55/00 280/47.26
6,053,516 A * 4/2000 Ottaway ..... B62B 1/264 280/47.24
6,598,889 B1 * 7/2003 Su ..... B62B 5/0083 248/96
7,114,730 B2 * 10/2006 Cheldin ..... B62B 5/0026 280/47.24
2002/0033583 A1 * 3/2002 Engelhardt ..... A63B 55/60 280/47.26
2004/0035728 A1 * 2/2004 Ortega ..... A63B 55/00 206/315.3
2007/0039794 A1 * 2/2007 Hwang ..... A45C 5/146 190/18 A
2007/0252353 A1 * 11/2007 Sokol ..... A63B 55/60 280/47.26

(Continued)

FOREIGN PATENT DOCUMENTS

WO PCT/US17/41083 8/2017

*Primary Examiner* — Erez Gurari

(74) *Attorney, Agent, or Firm* — Buche & Associates, P.C.; John K. Buche; Bryce A. Johnson

(57) ABSTRACT

A golf trolley that is easily attached to a golf bag or integrated into a golf bag, thus permitting the effective transport of a golf bag across a golf course. The golf trolley is collapsible and consists of several components that all fit within a pocket of a standard golf bag. The components of the golf trolley are compact, lightweight, and easily assembled and once assembled, a golfer can push or pull his golf trolley around a course.

13 Claims, 16 Drawing Sheets

(56) References Cited

U.S. PATENT DOCUMENTS

| | | | | |
|---|---|---|---|---|
| 2009/0314671 | A1* | 12/2009 | Anderson | A63B 55/00<br>206/315.3 |
| 2013/0200595 | A1* | 8/2013 | MacKay | A63B 55/08<br>280/655 |

* cited by examiner

FIG. 6A
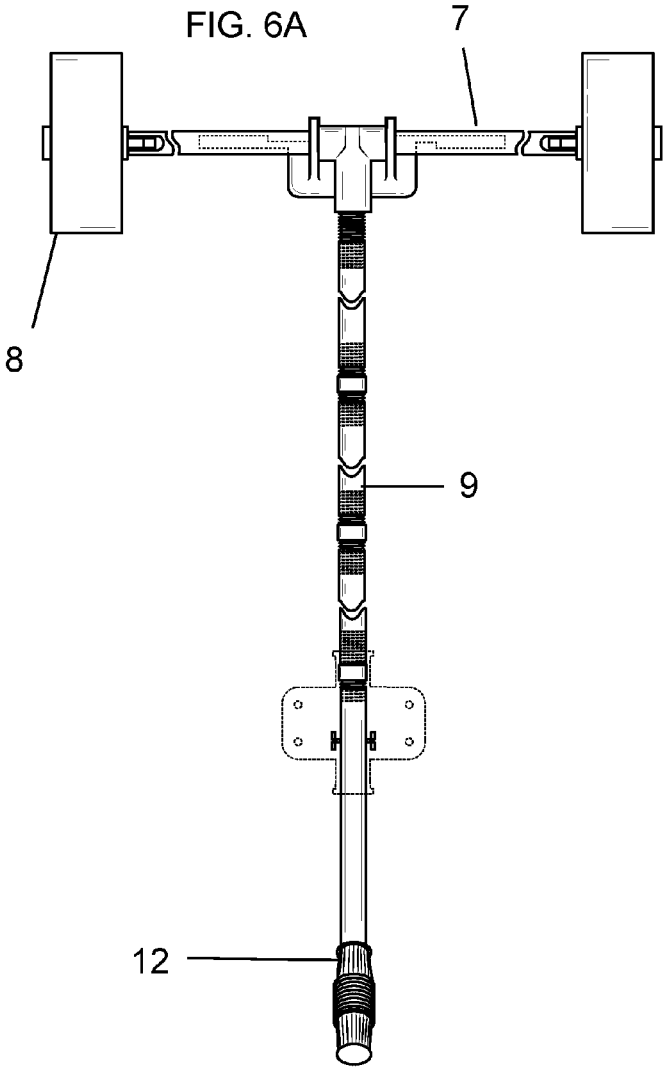
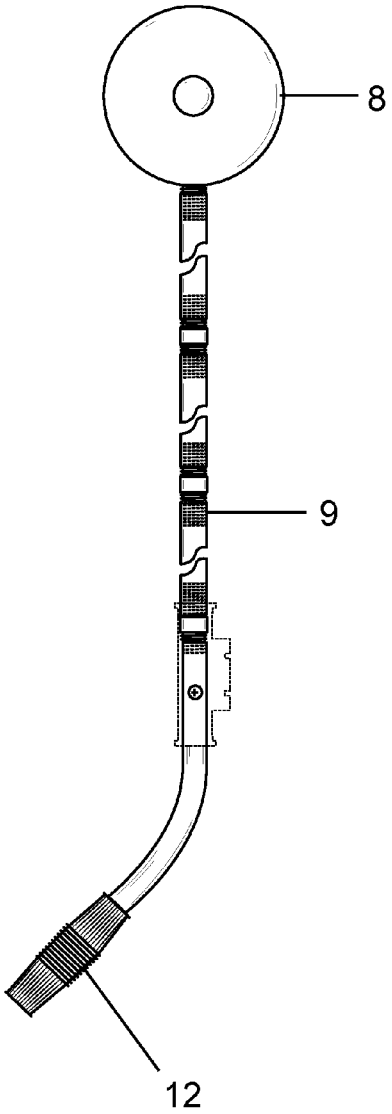
FIG. 6B
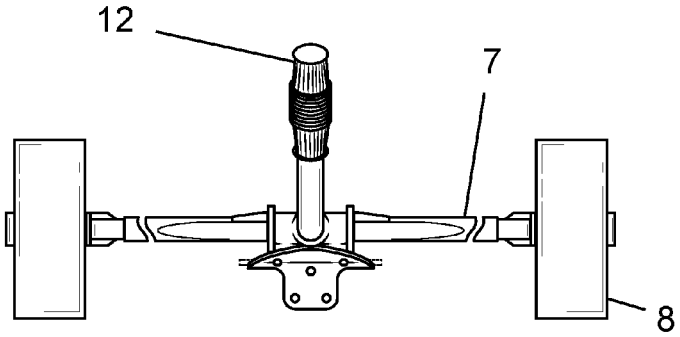
FIG. 6C

GOLF TROLLEY, SYSTEMS, AND RELATED METHODS

CROSS-REFERENCE TO RELATED APPLICATIONS

This application claims the priority and benefit of U.S. Prov. App. Ser. No. 62/333,440 (filed May 9, 2016) entitled GOLF TROLLEY. That provisional document is hereby incorporated by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The present invention relates generally to golf equipment, and more particularly, golf trolleys useful for the simple transport of golf bags.

Background of the Invention

The sport of golf is becoming increasingly popular among wide segments of the population. During play, golfers may wish to traverse the golf course by foot to obtain exercise. When walking the golf course, the golfer must transport a golf bag that contains clubs, golf balls, and other accessories. For many golfers, the challenge of carrying a heavy golf bag may be prohibitive to walking the golf course.

To address this concern, many golfers employ a golf trolley, which in some way connects the golf bag to a set of wheels, thus permitting the golfer to roll the golf bag around the course through the use of a handle. Many of the portable golf trolleys or carts available in the prior art suffer from consistent deficiencies, including complex assembly of the device, difficult attachment of the trolley to the golf bag, or large, bulky construction of the golf trolley or cart. Indeed, some existing golf trolleys weigh in excess of twenty pounds and take up as much space as the golf bag itself when stored. As a result, golfers typically do not own their own golf trolleys, but rather rent at the golf course to avoid the inconvenience of transporting such a bulky and awkward piece of equipment.

Thus, there has been a long-standing need in the golfing community for a simple, light-weight, and effective golf trolley that permits the transport of a golf bag. The present invention addresses these needs art by providing golf trolleys that are small, collapsible to sizes that fit in standard golf bags, and easily deployed.

SUMMARY OF THE INVENTION

The present invention addresses the limitations currently existing within the art and provides a golf trolley that is easily attached to a golf bag, thus permitting the effective transport of a golf bag across a golf course. The golf trolleys of the present invention include a base and optionally a handle and a spine that may be independently attached to a golf bag. The base preferably includes wheels that allow the golf bag to be rolled by the golfer. In some embodiments, the base of the golf trolley may be attached to the bottom of the golf bag by screws.

BRIEF DESCRIPTION OF THE SEVERAL VIEWS OF THE DRAWINGS

Other objectives of the disclosure will become apparent to those skilled in the art once the invention has been shown and described. For the present invention to be clearly understood and readily practiced, it will be described in conjunction with the following figures, wherein like reference characters designate the same or similar elements, which figures are incorporated into and constitute a part of the specification, wherein:

FIG. 6A is a back view of one embodiment of the golf trolley;

FIG. 6B is a side view of one embodiment of the golf trolley;

FIG. 6C is a top view of one embodiment of the golf trolley;

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

It is to be understood that the figures and descriptions of the present invention have been simplified to illustrate elements that are relevant for a clear understanding of the invention. The detailed description will be provided with reference to the attached drawings.

The present invention addresses the limitations currently existing within the art and provides a golf trolley (also a golf pull or push cart) that may be attached to an existing golf bag. Such embodiments may be easily snapped together and attached to the golf bag. The various components of these embodiments (e.g., the axle, wheels, spine, and handle may be stored in a standard pocket of the bag and are preferably light enough as to not be a burden to the golfer carrying the golf bag.

In certain embodiments, the attachable golf trolleys of the present invention include a base having wheels which may be attached to the bottom of a standard golf bag. The golfer may then grab a fabric grip that is part of the golf bag itself and roll the golf bag around the golf course as desired during play. Alternatively, the golf trolleys of the present invention may further include a spine with a handle that attaches to the golf bag, which would provide an accessible grip for the golfer to engage the golf bag during rolling of the golf bag around the course.

Golf bags commonly are made of a fabric (e.g., leather or nylon) and include both a hard solid base that extends for a short distance from the bottom of the bag and a firm solid rim at the top to provide structure to the golf bag. Many golf bags also possess screw holes that extend into the solid base of the golf bag.

In several embodiments, the components of the golf trolleys utilize these common structures of a golf bag to easily attach the component to the golf bag. That allows for simple transport of the golf trolley to and from the golf course, as well as full functionality on the golf course. In some embodiments, the functionality and structures of the base component and spine and handle component may be incorporated into the golf bag itself to form an integrated assembly.

Figure 1:
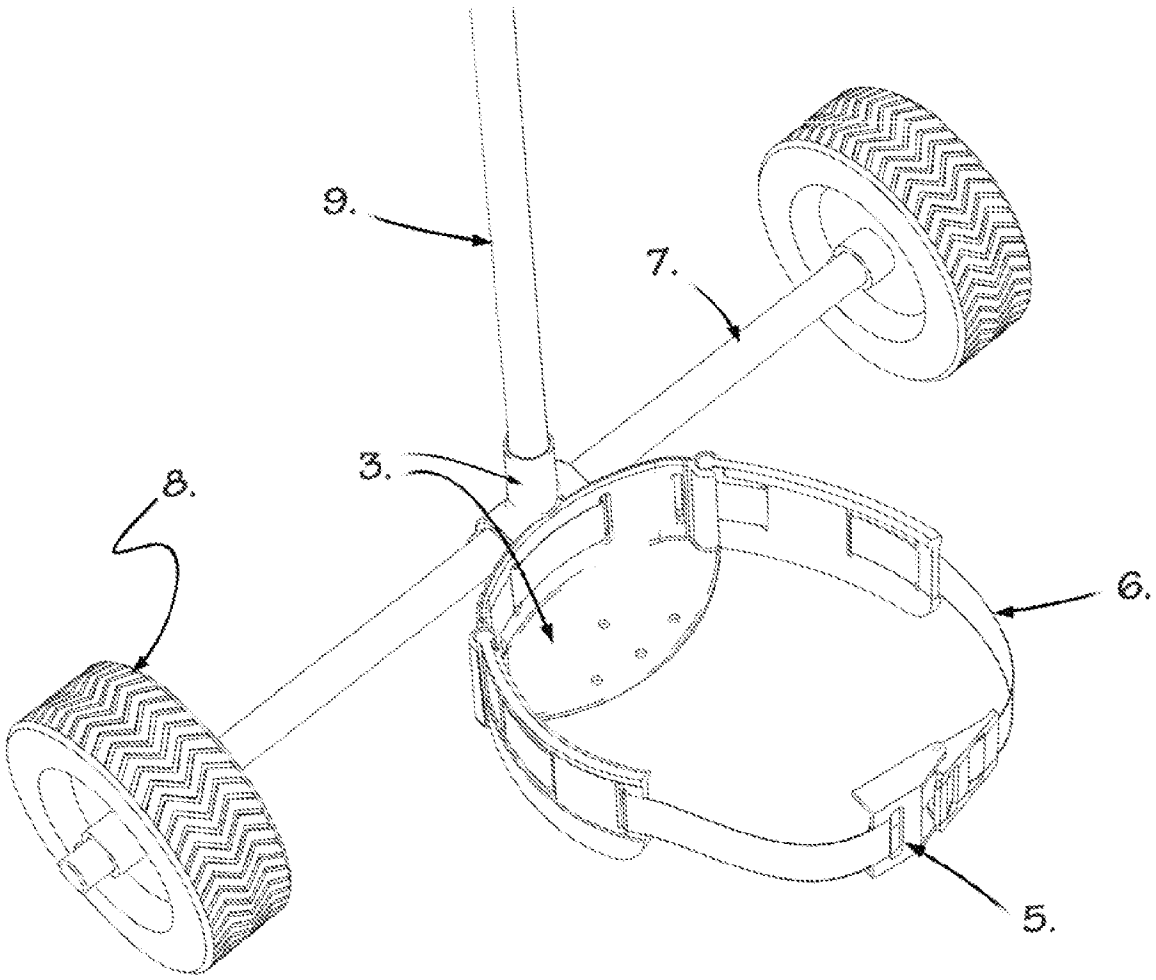
FIG. 1 is a perspective view of an embodiment of a base of a golf trolley.
Figure 2A:
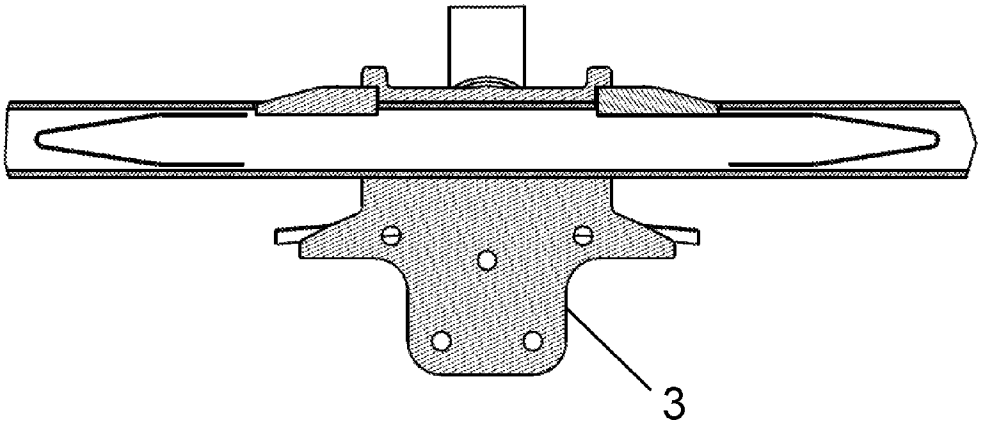
FIG. 2A shows an implementation of the base of a golf trolley.

FIG. 1 is a perspective view of an embodiment of a base of a golf trolley of the present invention. In some embodiments of the present invention, a base 3 as shown in FIG. 1 may be employed. The base 3 includes a substantially horizontal component having a curved outer perimeter that rests underneath where the golf bag would rest, as shown in FIG. 1. In other embodiments, the substantially horizontal component of the base 3 may have a T-shape (FIG. 2B) or a modified T-shape (FIG. 2A). In some implementations, the base component includes a curved, raised wall (FIGS. 1, 2B) which is substantially vertical and that may define a space in which the golf bag may rest, though some embodiments of the present invention lack that wall (FIG. 2A). In some implementations, the base component may include a strap 6 (FIG. 1) and a strap clamp 5 so that that strap 6 may be drawn around the golf bag so as to secure the golf bag more firmly to the golf trolleys of the present invention, though the inclusion of the strap is optional.

Figure 2B:
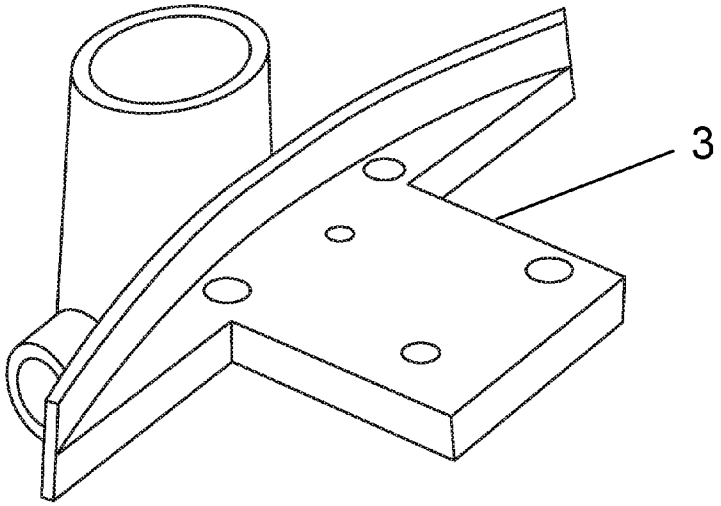
FIG. 2B shows an implementation of the base of a golf trolley.
Figure 2C:
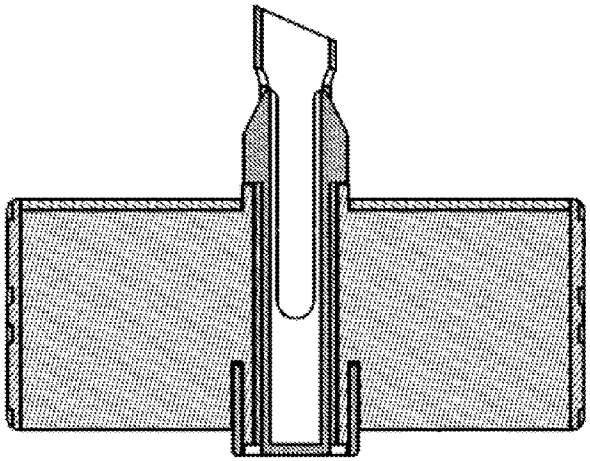
FIG. 2C shows an implementation of the base of a golf trolley.

Regardless of the shape it takes, the substantially horizontal component of the base preferably includes a plurality of holes capable of accommodating screws, as shown in FIGS. 1, 2A, and 2B. Screws may be driven through that plurality of holes in the base and into the bottom of the golf bag to secure the base to the golf bag.

Figure 3:
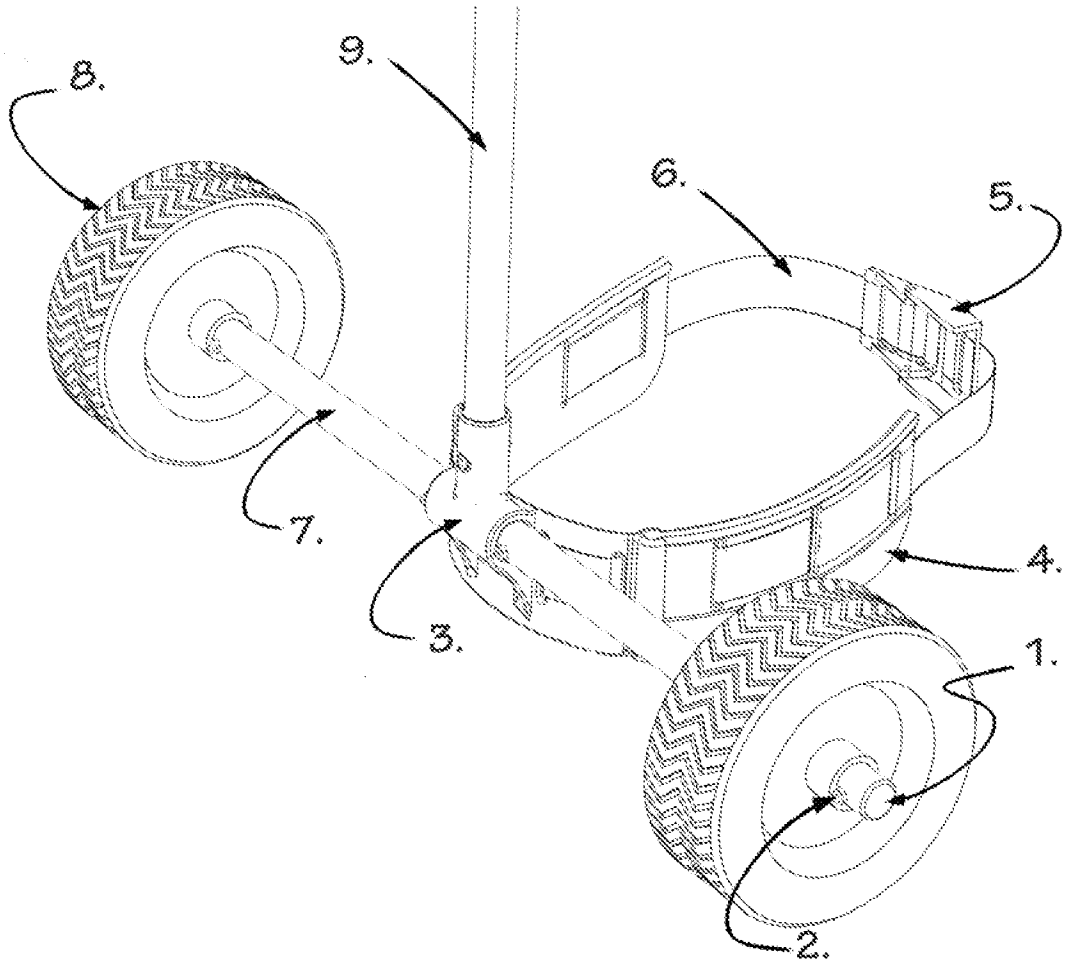
FIG. 3 shows a further view of an embodiment of a base of a golf trolley.

In the embodiment shown in FIGS. 1, 2B, 2C, and 3, the base 3 component may also include a T-shaped component that may be secured to the base. In some embodiments (e.g., FIGS. 1, 2B, and 3), the T-shaped component possesses a horizontal segment and a vertical segment that is substantially orthogonal to the horizontal segment. In some embodiments, both the horizontal and vertical segments are tubular and open on the ends. The open end of the vertical segment points up and is capable of accommodating a spine 9, as shown in FIGS. 1 and 3 and as discussed further below.

The horizontal segment of the T-shaped component is capable of accommodating an axle 7, which may loosely slide through the horizontal segment, as shown in FIG. 3. The axle 7 may be centered on the T-shaped component through the use of a series of spring buttons that protrude through numerous holes present in the wall of the axle 7. When the spring button is depressed, the axle 7 may easily be slid through the horizontal segment of the T-shaped component. When the spring button is released, the axle's lateral movement through the horizontal component is limited, thus roughly centering the axle 7 on the base 3 component through the horizontal segment. Also, in a preferred embodiment, the base 3 may feature a curved support 4 to help receive and support the bottom of a golf bag.

Figure 4:
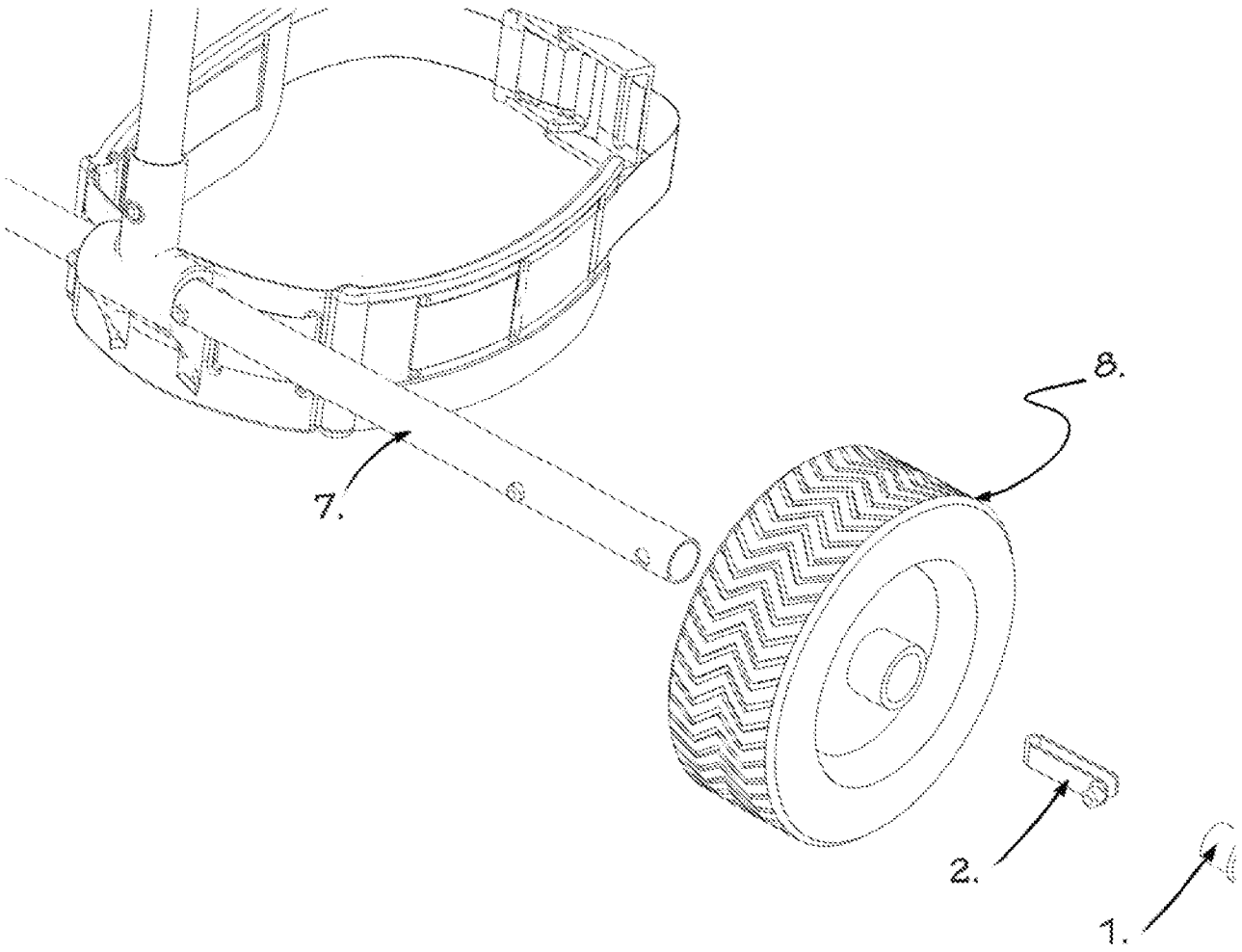
FIG. 4 displays an exploded view of an axis that may be used with a base of a golf trolley.

The axle 7 may also include spring buttons at each of its distal ends. By depressing the spring buttons, a user may easily attach wheels 8 to the distal ends of the axle 7, as shown in FIG. 4. In certain embodiments, the axle 7 is of a sufficient length that the attached wheels 8 are placed outside of the width of any golf bag that is attached to the base 3 component. In certain preferred embodiments, the axle 7 is approximately twice the width of the golf bag. In those embodiments, the wheels 8 are thus located a sufficient distance from the center of the golf bag to permit the golf bag to be well balanced during rolling of the golf bag during play. Still referring to FIG. 4, in one embodiment, wheel clip 2 is inserted to the axle 7 and has a protrusion that fits a hole in the axle 7 so that it locks the wheel in place. In a preferred embodiment, there is a wheel cap 1 that slides over the end of an axle 7. In one assembly embodiment, the wheel 8 slides onto the axle 7 and then a user inserts the wheel clip 2 into the axle 7 to hold the wheel in place and slides the wheel cap 1 over the end of the axle 7. In yet another embodiment, the wheels 8 may snap or clip securely in place on the end of an axle 7, so that a wheel clip 2 or wheel cap 1 are not necessary.

In a preferred embodiment, the length of the axle 7 is approximately 22 inches, the width of the wheels 8 are approximately 2 inches, and the length of the spine 9 with the handle 12 is approximately 47 inches and the length of the spine 9 may be approximately 38 inches. In one embodiment, the depth of the base 3 may be approximately 3 inches and the width of the base may be approximately 4 inches. The diameter of the wheels 8 may be approximately 5 inches. Variations on the dimensions can be made without departing from the spirit of this application.

In a preferred embodiment, all of the components of the golf trolley can fit within a side pocket of a standard golf bag that may have a range of dimensions between 48-52 inches×

10-16 inches×8-14 inches. The components can fit within a pocket of a standard golf bag, wherein the pocket is approximately 20-30 inches in length and approximately 3-5 inches wide. In yet another embodiment, a pocket of a standard golf bag may be approximately 30-50 inches in length. In one embodiment, the spine 9 and axle 7 may be telescoping in nature, segmented so that parts of the spine 9 may be inserted, screwed, or fit into each other to further reduce the size of the side pocket necessary to fit the components of the golf trolley.

The components of the golf trolley can be made from plastic, metal, carbon fiber, alloys, and other rigid materials. The components of the golf trolley may collectively weigh anywhere between 3 to 15 lbs depending on the material used. In yet another embodiment, the golf trolley assembly is in a range of not more than 15 lbs.

Through these mechanisms, the base component of the golf trolleys of the present invention may be secured to a golf bag to permit a golfer to transport the golf bag around a golf course by rolling the golf bag. The golfer may employ only a base component of the present invention and utilize a handle on the golf bag or even the rim of the golf bag itself to achieve rolling of the golf bag.

Figure 5:
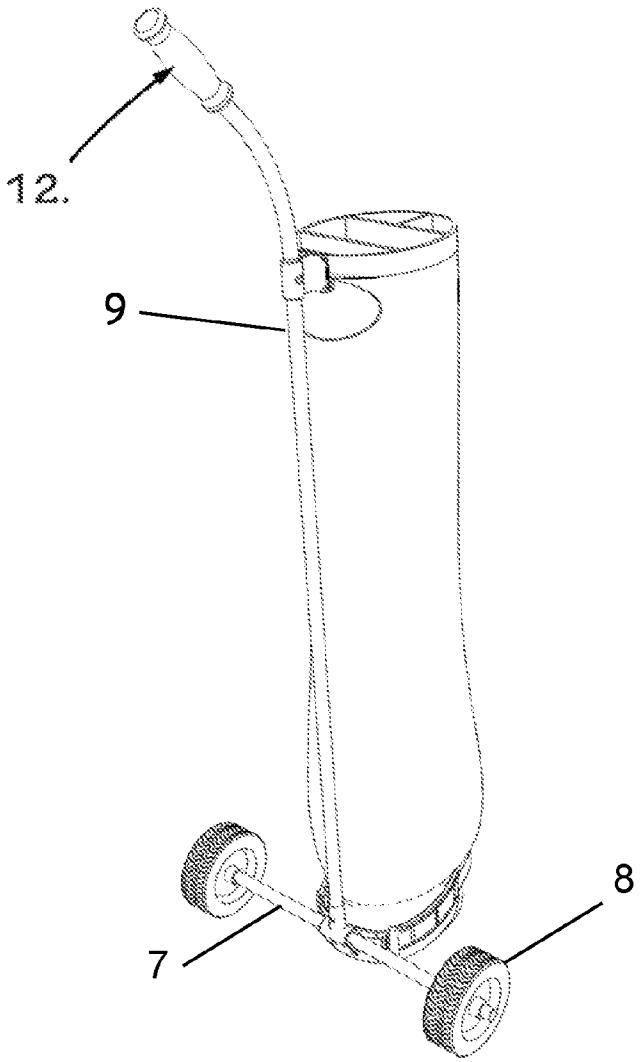
FIG. 5 displays a golf trolley attached to a golf bag.

In other embodiments of the present invention, a handle 12 for pulling the golf trolley with a golf bag may be attached to the spine 9 of the golf trolley. An example of such an embodiment attached to a golf bag is shown in FIG. 5.

FIG. 6A is a back view of one embodiment of the golf trolley. FIG. 6B is a side view of one embodiment of the golf trolley. FIG. 6C is a top view of one embodiment of the golf trolley.

In other embodiments, the handle 12 may screw into the spine 9 of the golf trolley. In these embodiments, the spine 9 may be threaded internally so as to permit the handle 12 to screw securely into the spine 9. In some embodiments, the handle 12 may be telescopic, such that it may expand from a small, easy-to-store size to a length that is a substantial portion of the golf bag's height. In some embodiments, the handle 12 may even extend from the base component to above the rim of the attached golf bag.

Figure 7:
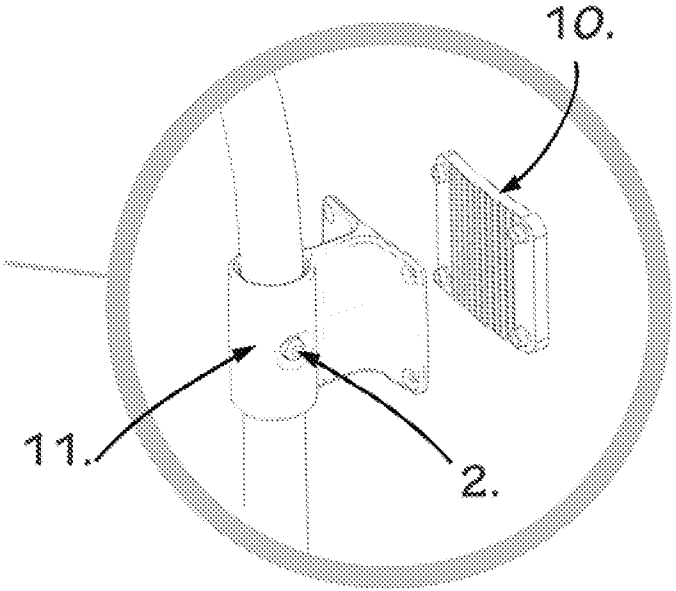
FIG. 7 shows an expanded view of a handle of a golf trolley.

In one embodiment, the top of the handle 12 may be fastened to the top of the golf bag through the use of an external clamp base 11, as shown in FIG. 7. The top of the handle 12 may include an additional spring button that may engage a hole 2 present in a vertical tubular component of the external clamp base 11, as shown in FIG. 7. The vertical tubular component of the external clamp base 11 may be connected to a short arm that widens into a clamp face that includes several holes capable of accommodating screws or other fasteners. The clamp face may be located at the bottom of the vertical tubular component, at the top of the vertical tubular component, or both. The clamp face may rest opposite to the exterior side or rim of the golf bag. A complementary internal clamp component 10 may be placed on the inside of the bag, as shown in FIG. 7, and may be secured to the external clamp base through screws or other fasteners that pass through the holes in the clamp face and penetrate the golf bag to be secured to the internal clamp component 10.

In those embodiments employing this design using the vertical handle bar, a handle may also be connected to the tubular portion of the external clamp base, as shown in FIG. 7. Several types of fasteners may be employed to attach the handle component to the golf bag. For example, flat-ended screws may be used to clamp the vertical handle bar to the bag. Alternatively, self-tapping screws may be used to clamp the vertical handle bar to the bag by screwing across the fabric of the golf bag. In other embodiments a thumb screw or push button connector may be employed.

Figure 8:
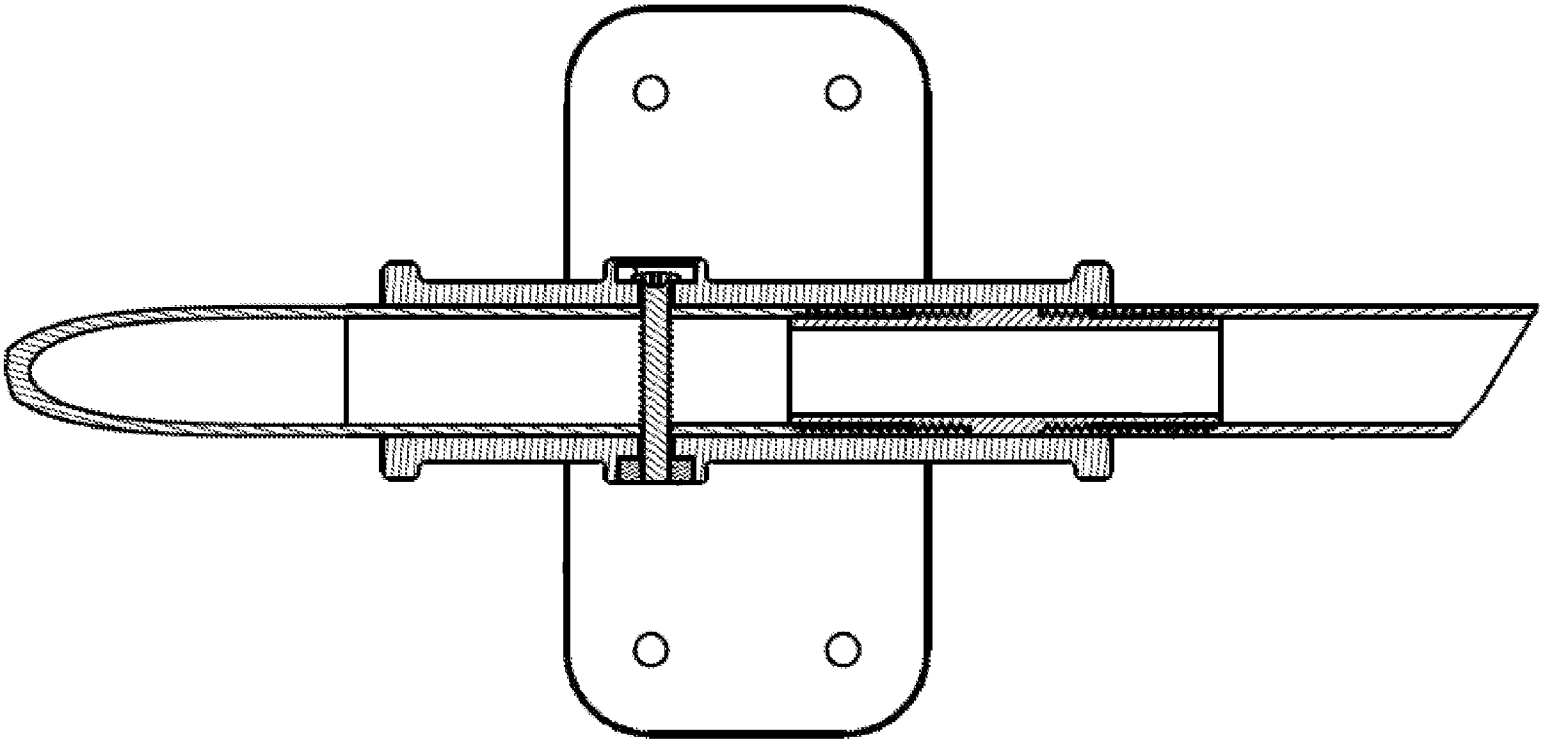
FIG. 8 shows an alternative implementation of a handle of a golf trolley.
Figure 9:
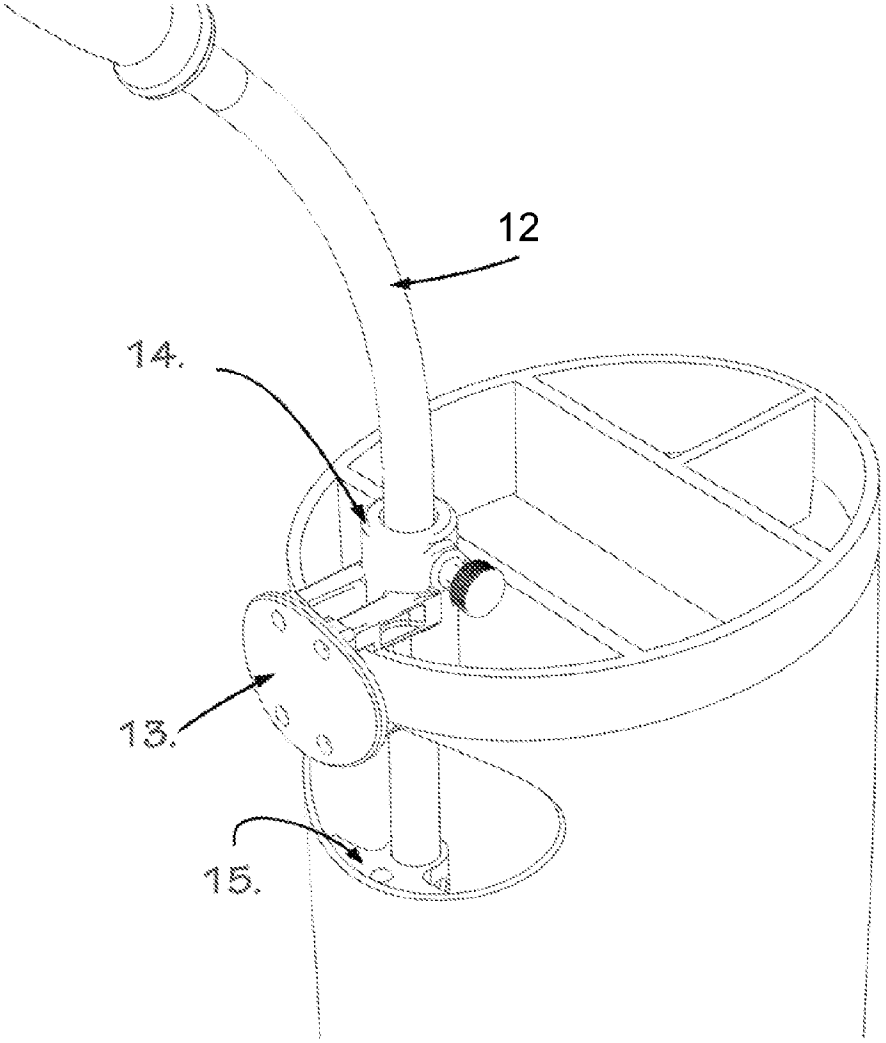
FIG. 9 shows a mechanism by which a spine of a golf trolley may attach to a golf bag.

FIG. 8 is a cross-sectional view of one embodiment of the implementation of a handle of the golf trolley. FIG. 9 is a perspective view of a handle attachment to an existing golf bag. Referring to FIG. 9, in some embodiments, the clamp 13 may be implemented without the complementary internal clamp component, such that it structurally resembles a curved plate. FIG. 9 shows the handle 12 secured to the curved plate. The plate is curved so that it may roughly match and easily accommodate a golf bag. Self-tapping screws may then be used to attach the curved plate to the golf bag. In other embodiments, the handle may be placed around the rim of the golf bag and secured to the bag, as shown in FIG. 9. In one embodiment, an interior support 15 is installed in the interior of the golf bag to hold. Still referring to FIG. 9, the handle 12 may be inserted and secured into a handle receiver 14 that attaches to the bag via the clamp 13 that can be installed onto an existing golf bag.

In use, in one embodiment, a golfer will remove at least one axle 7, a base 3, a spine 9, a handle 12, and a wheel assembly (including the wheels 8 wheel clip 2, and wheel cap 1) from a pocket of a golf bag. A golfer can assembly his golf trolley by placing an axle through a horizontal bore on the base 3, until the axle 7 is locked in place via a spring mechanism. A golfer may then insert a wheel 8 onto each side of the axle 7 and lock the wheel in place via wheel clip 2 and a wheel cap 1. A golfer may then insert a spine 9 into a vertical slot on the base 3, so that a vertical bar can support the length of a golf bag. A golfer may then insert a handle 12 into the spine 9. The top of the spine 9 may feature an external clamp 11 that supports the top of a golf bag so that the golf bag does not fall off of the golf trolley. In an alternative embodiment, the spine 9 may feature a curved support with a strap that receives and supports the top or middle portion of a golf bag. Once the golf trolley is assembled, the golfer may place his or her golf bag on the trolley, secure the bottom of the bag to the base 3 and the top or middle of the bag to the spine 9 and pull or push the cart around a course.

In yet another embodiment, a base 3 is secured to the bottom of a golf bag and an axle 7 may be threaded through a portion of the base 3. A golfer may then slide and clip wheels 8 onto each end of the axle 7 so that the wheels 8 rotate securely around the axle 7. A golfer may then take a handle 12 and insert and clip it into a receiver on the top portion of the golf bag.

Figure 10:
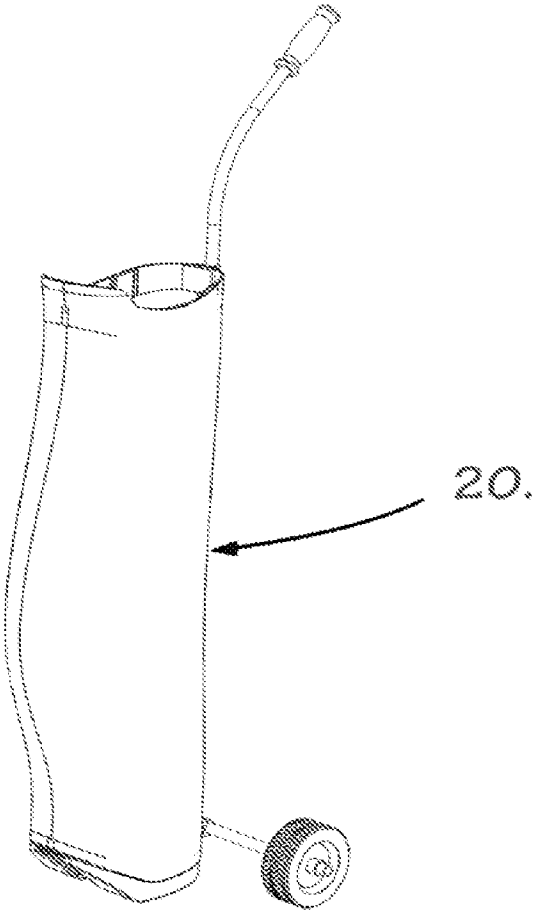
FIG. 10 displays a golf trolley that is integrated into a golf bag.

FIG. 10 is a perspective view of one embodiment of the golf trolley integrated within a golf bag. Referring to FIG. 10, in one embodiment, the golf trolleys of the present invention may be incorporated into a golf bag so as to form an integrated golf bag and golf trolley assembly. The implementation of these integrated assemblies is similar to the detachable assembly described above. In these embodiments, the base component 3 and spine 9 are not visible when observing the exterior of the golf bag and are instead largely concealed within the external fabric 20 of the golf bag.

Figure 11:
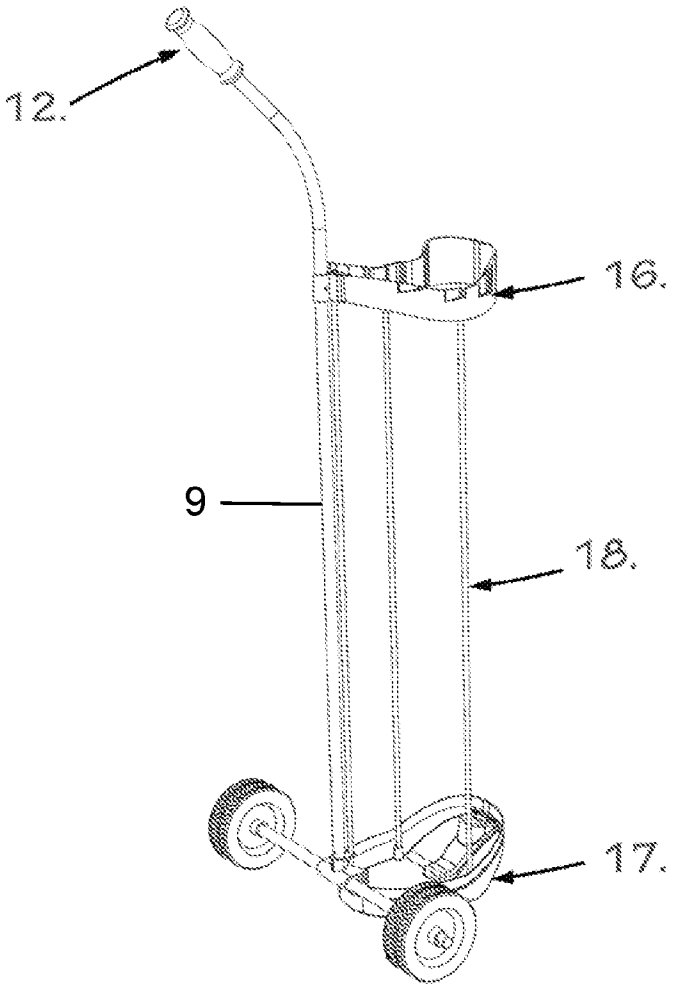
FIG. 11 shows the entire framework of a golf trolley integrated into a golf bag.

FIG. 11 displays a view of relevant components of the integrated system without the fabric 20 of the golf bag. The top aspect of the handle 12 may be connected through a vertical tubular component that is part of or connected to a perimeter support member 16 that may reside at and form part of the top rim of the golf bag. A handle 12 may be attached to the top of the spine 9, as described above. The handle 12 may be attached by the mechanisms discussed above. In some embodiments, the handle 12 and other components may be molded together with other structural component during fabrication.

As shown in FIGS. 10 and 11, the present invention provides for the creation of golf bags that have a golf trolley integrated into the golf bag. The components described above may be integrated into the structure of the golf bag, providing an aesthetically pleasing, functional golf bag and golf trolley system. Both the embodiment shown in FIGS. 10-11 (where the golf trolley is integrated into the golf bag) and the embodiments shown in FIGS. 1-9 (where a golf trolley is retrofitted onto existing golf bags) are encompassed within the scope of the present invention.

Figure 12:
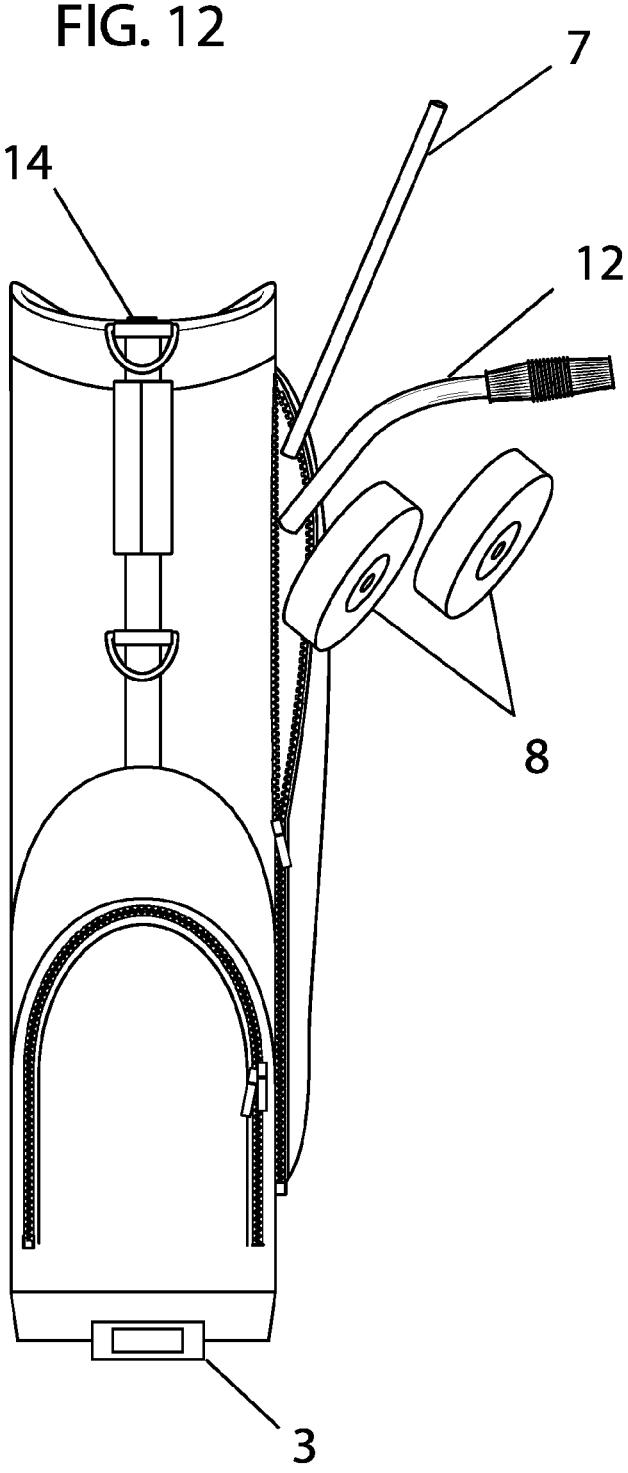
FIG. 12 is an environmental view of one embodiment of a golf bag that is convertible into a golf trolley.

FIG. 12 is a perspective view of one embodiment of a convertible golf bag. In yet another embodiment, a golf bag may be configured to convert into a golf trolley. Referring to FIG. 12, a golf bag is outfitted with a base 3 that is secured to the bottom of the golf bag and the base 3 features a horizontal receiver. The golf bag also features a vertical handle receiver 14 to receive a handle 12. Still referring to FIG. 12, an axle 7, a handle 12, and wheels 8 are stored in the golf bag's pocket, or pockets. Before converting the golf bag into a golf trolley, the user may remove the axle 7, handle 12, and wheels 8 from the golf bag's pocket or pockets.

Figure 13:
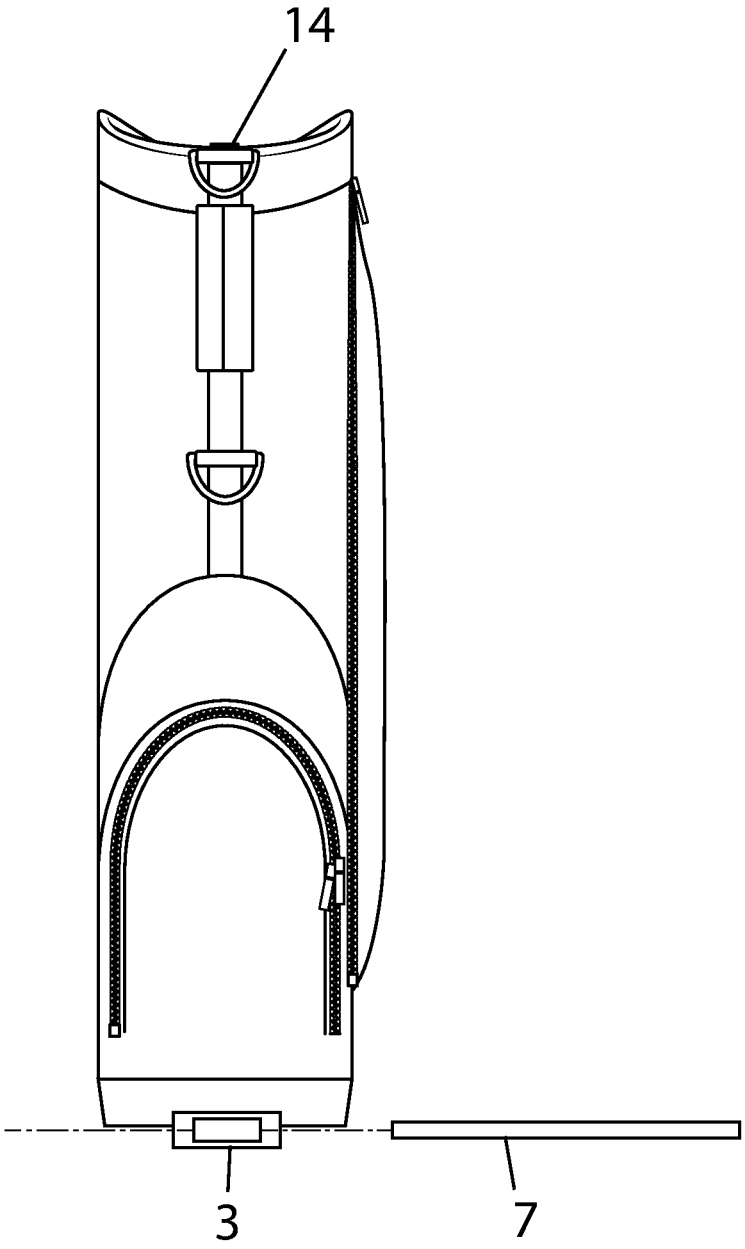
FIG. 13 is an illustrative view of converting one embodiment of a golf bag into a golf trolley.

FIG. 13 is an illustrative example of how a user may convert the golf bag into a golf trolley. Referring to FIG. 13, the user will thread or insert the axle 7 through the horizontal receiver of the base 3.

Figure 14:
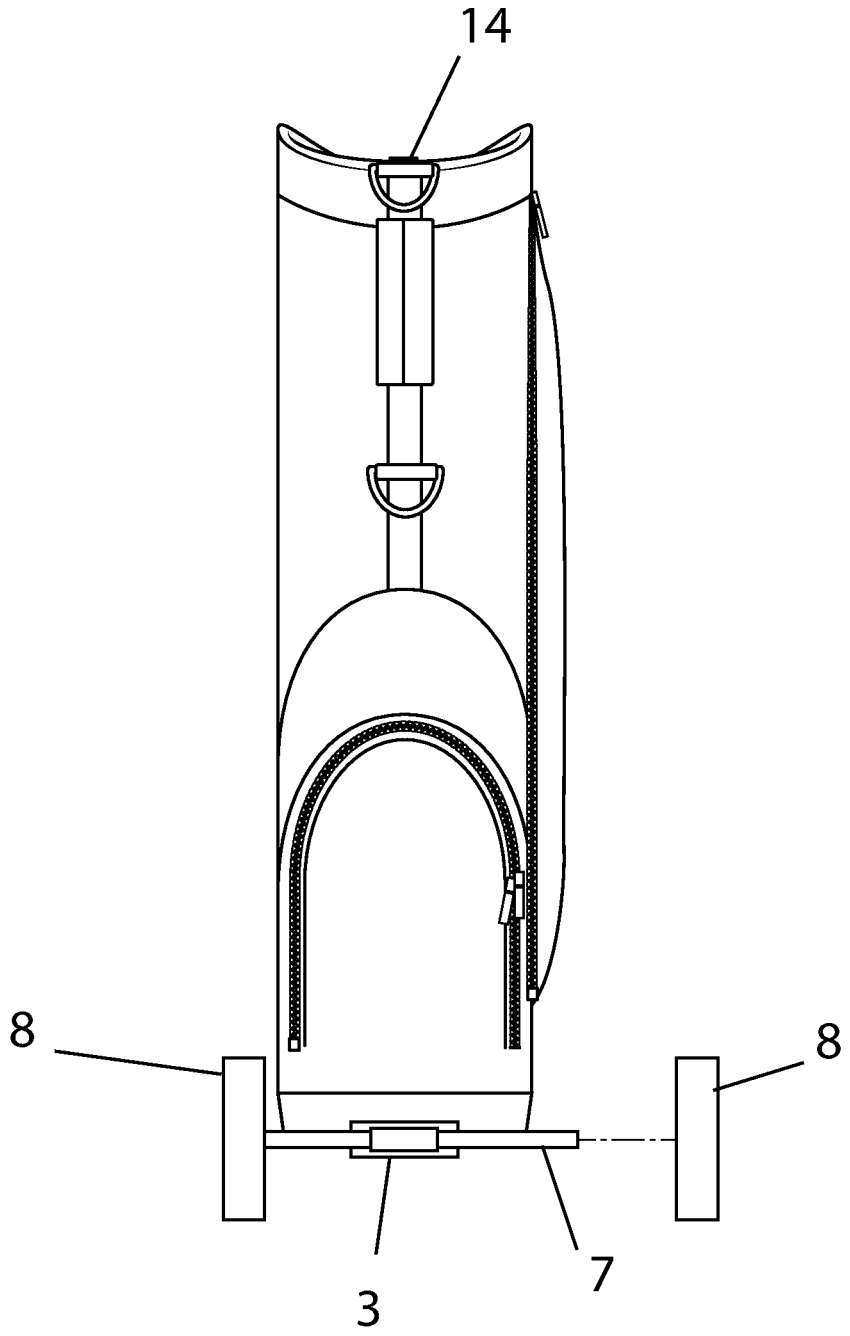
FIG. 14 is an illustrative view of converting one embodiment of a golf bag into a golf trolley.

FIG. 14 is an illustrative example of how a user may convert the golf bag into a golf trolley. Referring to FIG. 14, after the axle 7 is inserted through the horizontal receiver of the base 3, the user may secure wheels 8 to both ends of the axle 7 by sliding and clipping them into the ends of the axle 7. The wheels 8 may be part of a wheel assembly that contain wheel clips, wheel caps, or other fasteners known to one of skill in the art.

Figure 15:
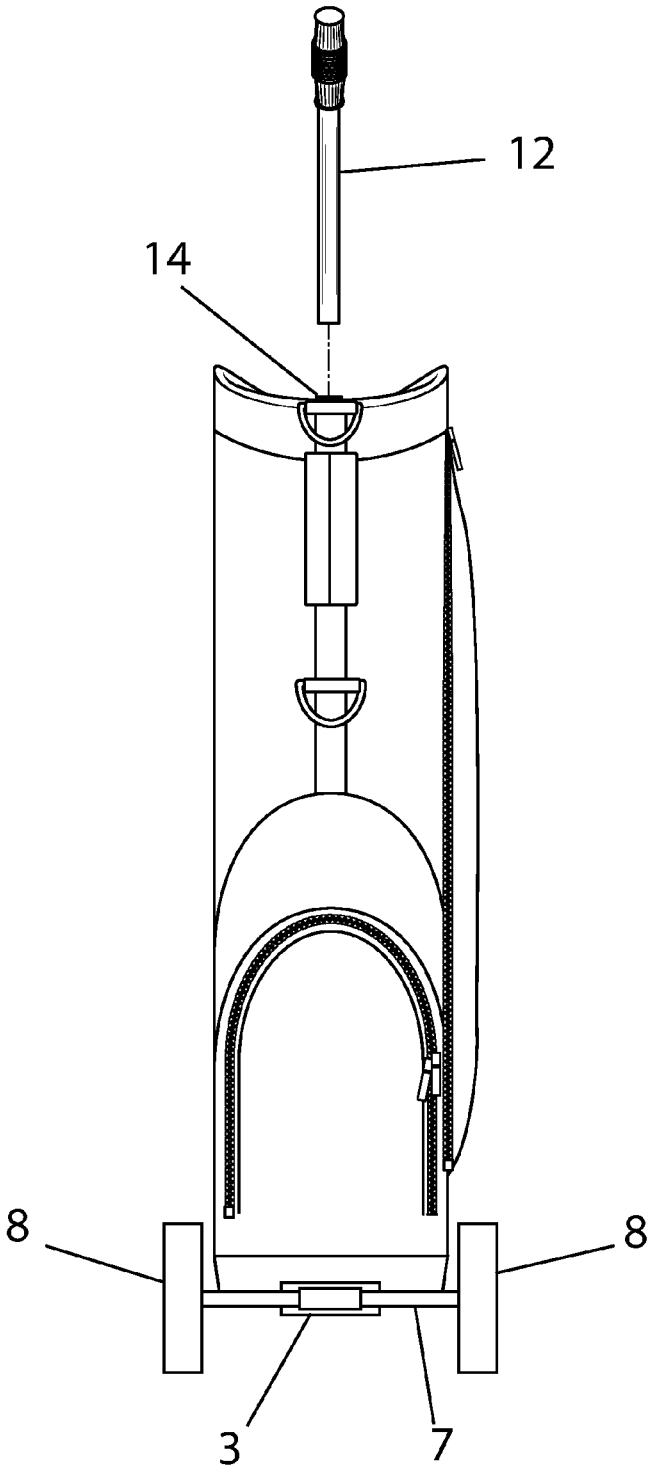
FIG. 15 is an illustrative view of converting one embodiment of a golf bag into a golf trolley.

FIG. 15 is an illustrative example of how a user may convert the golf bag into a golf trolley. Referring to FIG. 15, after the wheels 8 are secured to the axle 7, a user inserts and secures the handle 12 into the vertical handle receiver 14 that is located at the top of the golf bag. The handle 12 may feature a spring button to clip into the handle receiver 14 or it may be threaded to screw into the handle receiver 14.

Figure 16:
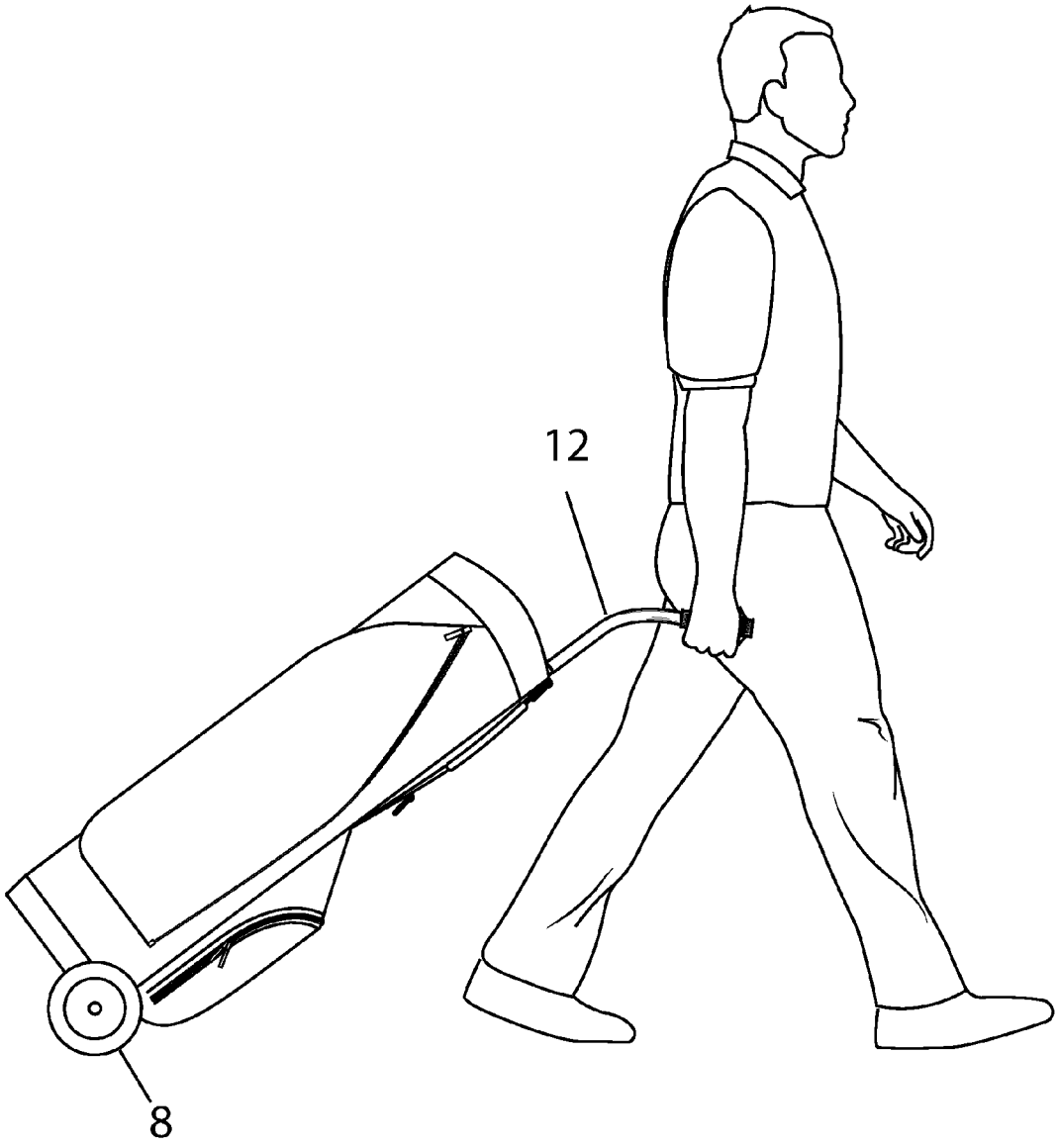
FIG. 16 is an exemplary view of a golfer pulling one embodiment of a golf bag that has been converted to a golf trolley.

FIG. 16 is an exemplary view of how the golf bag may be used after it is converted into a golf trolley. Accordingly, in use, to convert the golf bag to a golf trolley, a user may: (i) remove the axle 7, handle 12, and wheels 8 from the golf bag; (ii) inserted the axle 7 through the horizontal receiver of the base 3; (iii) secure the wheels 8 to the ends of the axle 7; (iv) and insert the handle 12 into the vertical handle receiver 14 at the top of the golf bag. Then, the golfer can push or pull his golf bag around a golf course. These steps to convert a golf bag to a golf trolley may be performed in a variety of orders. In this embodiment, where a golf bag already has a base and handle receiver secured to it, a user may have the components of a golf trolley conveniently stored in the golf bag, which provides a very simple and quick way to convert the golf bag into a golf trolley to push or pull around a golf course.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are offered only to facilitate comprehension of the invention and should not be construed to limit the scope thereof.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A collapsible golf trolley that may fit into a pocket of a golf bag comprising a system of assemblable parts comprising: a t-shaped base integrally connected with a t-shaped receiver; a spine that is inserted into a vertical slot of the t-shaped receiver; at least one axle that is inserted through a horizontal bore of the t-shaped receiver; a wheel assembly, wherein a first wheel and a second wheel are fit onto each side of said axle(s); and, a handle that can be fit onto the top of the spine.

2. The golf trolley of claim 1 in a weight range of 3 lbs to 15 lbs.

3. The golf trolley of claim 1 that is collapsible into a golf bag pocket that is 40-50 inches in length and 3-5 inches wide.

4. The golf trolley of claim 1, wherein the base features a curved support.

5. The golf trolley of claim 1, wherein the base features a strap.

6. The golf trolley of claim 5, wherein the base features a strap clamp.

7. The golf trolley of claim 1, wherein the spine features an external clamp.

8. The golf trolley of claim 1, wherein the spine features a curved support.

9. The golf trolley of claim 7, wherein the spine features a strap.

10. The golf trolley of claim 1, wherein the handle features a grip.

11. The golf trolley of claim 1, wherein the spine is telescoping.

12. The golf trolley of claim 1, wherein the spine is segmented.

13. The golf trolley of claim 1, wherein the at least one axle is telescoping.

* * * * *